United States Patent [19]

Nagai et al.

[11] Patent Number: 5,066,201

[45] Date of Patent: Nov. 19, 1991

[54] DRIVING LOAD CONTROLLER FOR VARIABLE DISPLACEMENT TYPE HYDRAULIC PUMP

[75] Inventors: Katsumi Nagai; Teruyuki Nishimyou, both of Kariya; Masataka Osawa, Nagoya; Hitoshi Ban, Oobu, all of Japan

[73] Assignees: Kabushiki Kaisha Toyoda Jidoshokki Seisakusho, Kariya; Kabushiki Kaisha Toyota Chuo Kenkyusho, Aichi, both of Japan

[21] Appl. No.: 565,052

[22] Filed: Aug. 9, 1990

[30] Foreign Application Priority Data

Aug. 17, 1989 [JP] Japan ..... 1-210668

[51] Int. Cl.[5] ..... F04B 49/02

[52] U.S. Cl. ..... 417/222 R; 60/443

[58] Field of Search ..... 417/212, 218, 221, 222; 60/329, 443

[56] References Cited

U.S. PATENT DOCUMENTS

| | | | |
|---|---|---|---|
| 4,074,955 | 2/1978 | Nonnemacher et al. | 417/218 |
| 4,274,257 | 6/1981 | Koch, Jr. et al. | 417/222 |
| 4,534,707 | 8/1985 | Mitchell | 417/222 |
| 4,600,364 | 7/1986 | Nakatani | 417/218 |
| 4,892,465 | 1/1990 | Born et al. | 417/218 |

*Primary Examiner*—Richard A. Bertsch
*Assistant Examiner*—Peter Kuryinyk
*Attorney, Agent, or Firm*—Brooks Haidt Haffner & Delahunty

[57] ABSTRACT

A controller in which a starting state is detected for the controller to control a displacement varying mechanism of the pump by the detected result of the starting state to minimize the discharge capacity of the pump, thereby minimizing the driving load of the pump. In this manner, the starting properties of the engine are improved to reduce consumption of energy at the starting time.

10 Claims, 2 Drawing Sheets

DRIVING LOAD CONTROLLER FOR VARIABLE DISPLACEMENT TYPE HYDRAULIC PUMP

FIELD OF THE INVENTION

This invention relates to a variable displacement type hydraulic pump used for hydraulic circuits of industrial vehicles and, more particularly, to a device for controlling a driving load generated when the pump is driven.

BACKGROUND OF THE INVENTION

As a variable displacement type hydraulic pumps, swash plate type axial piston pumps are generally known. Hydraulic pumps of this type can vary their discharging capacity by regulating the inclination angle of a swash plate (swash plate angle).

FIG. 1 schematically shows a displacement varying mechanism for a conventional swash plate type axial piston pump 1. The displacement varying mechanism has a control cylinder 2, which is disposed in the vicinity of one side of the swash plate 3 of the hydraulic pump 1, and its piston rod 4 is pivotally secured to the end of that side of the swash plate 3. When the pilot pressure of the discharge side of the hydraulic pump 1 is applied to the control cylinder 2, the piston rod 4 of the control cylinder 2 is telescopically extended and contracted to vary the inclination angle $\theta$ of the swash plate 3. The pilot pressure of the hydraulic pump 1 to the control cylinder 2 is controlled by a solenoid switching valve 5 interposed in a pilot conduit 6, and the switching valve 5 has its positions switched by a signal from a switching valve driving circuit 7.

In a conventional hydraulic pump 1 having the displacement varying mechanism as described above, the pilot pressure of the discharge side of the pump 1 is zero when the pump 1 is stopped, and the swash plate angle $\theta$ is maximized by a compression spring 8 connected to the other side of the swash plate 3. Accordingly, the discharge capacity of the pump 1 is at maximum when the pump is started so the driving load of the hydraulic pump 1 becomes maximum, and thus the load applied to a drive source 9 for driving the hydraulic pump 1 becomes large. Particularly, in the case of industrial vehicles, since the hydraulic pump 1 is used as a drive source for loading/unloading operations, etc., it should have a relatively large discharge capacity, and the load applied to the drive source 9 is inevitably large. Therefore, if the viscosity of hydraulic fluid or working oil is high at low temperatures, there is a fear that the startability of the industrial vehicle will be deteriorated.

SUMMARY OF THE INVENTION

Accordingly, an object of this invention is to provide a driving load controller for a variable displacement type hydraulic pump which can minimize the driving load of the hydraulic pump when the pump is started.

In order to achieve the above and other objects, there is provided according to this invention a driving load controller for a variable displacement type hydraulic pump comprising means for detecting that a drive source for driving the variable displacement type hydraulic pump is in a starting state, a controller for outputting a signal for minimizing the driving load of the hydraulic pump when the drive source is in the starting state in response to a signal from the start detecting means, and driving load working means for minimizing the driving load of the hydraulic pump by a signal from the controller.

When the arrangement of the hydraulic pump described above, since the pump state is determined from the state of the drive source, and the driving load of the hydraulic pump can be minimized under the control of the controller when the pump is started, the load applied to the drive source can be alleviated.

These and other objects and features of the present invention will become apparent from the following detailed description in conjuction with the attached drawings.

DETAILED DESCRIPTION OF THE PREFERRED EMBODIMENT

Figure 1:
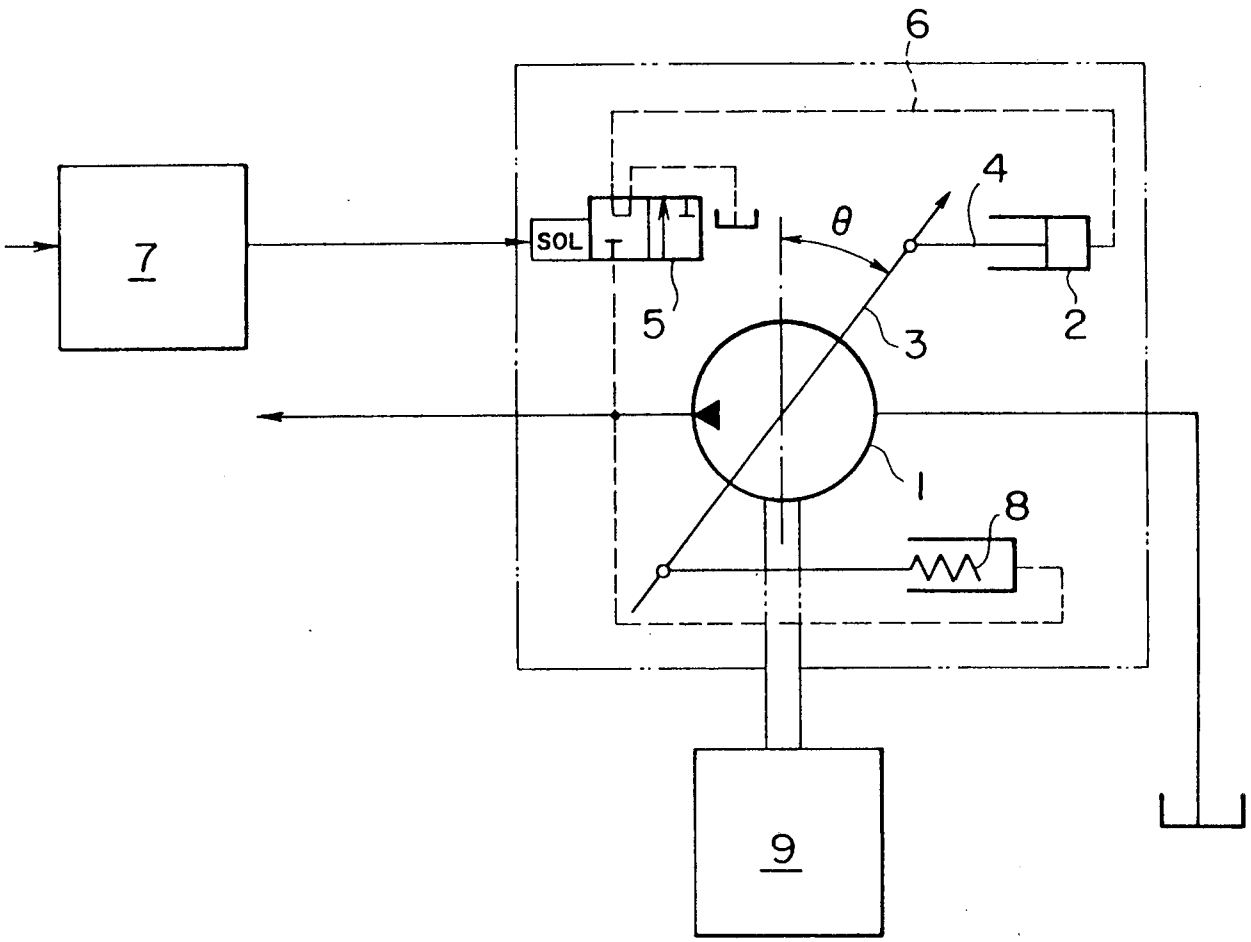
FIG. 1 PRIOR ART
FIG. 1 is a schematic explanatory view showing a conventional variable displacement type hydraulic pump.
Figure 2:
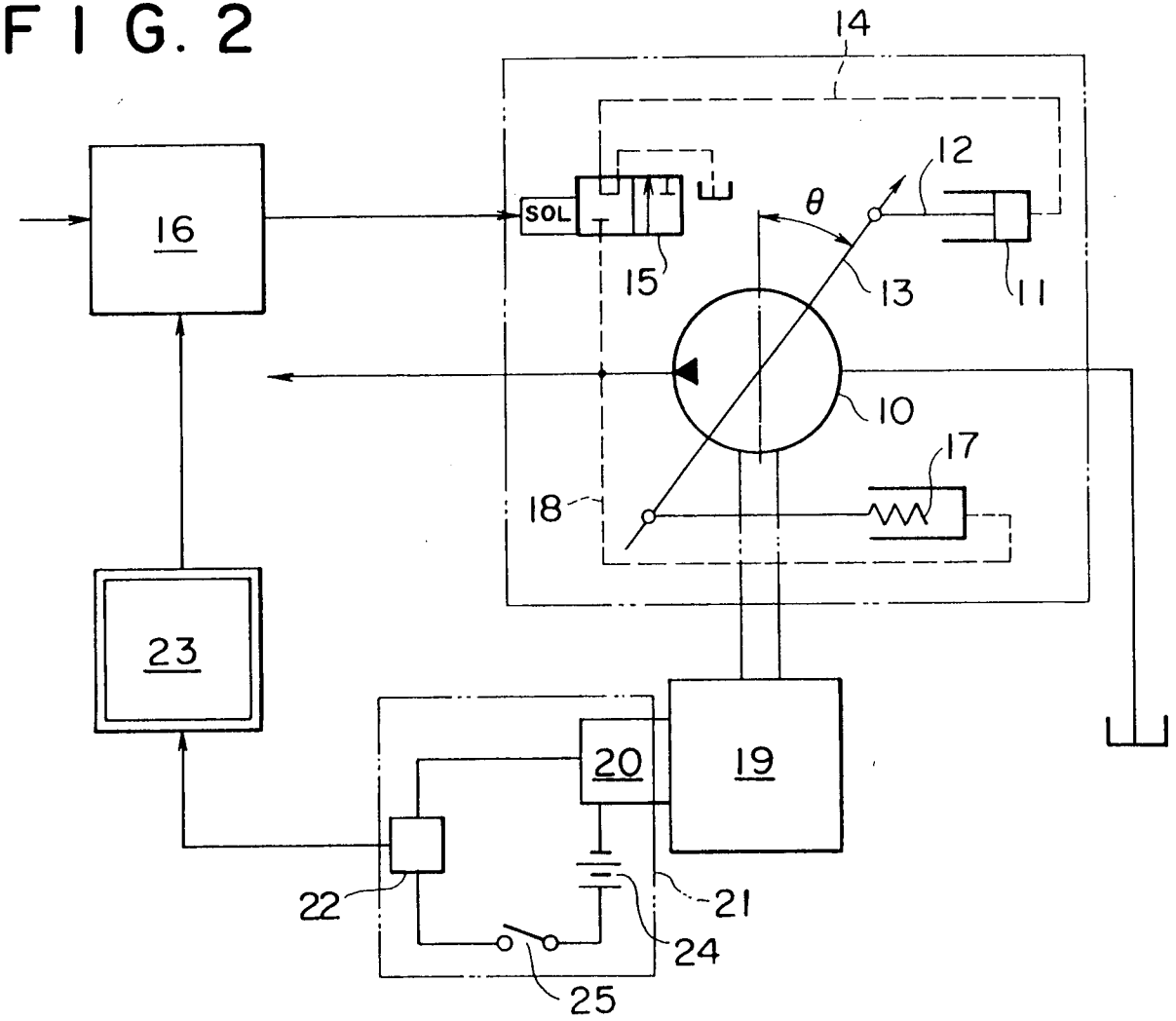
FIG. 2 is a schematic explanatory view showing a variable displacement type hydraulic pump associated with a controller according to the present invention.

Referring to FIG. 2, a driving load controller for a variable displacement type hydraulic pump composed according to the present invention is shown.

As shown in FIG. 2, a variable displacement type hydraulic pump 10 to which the present invention is applied is a swash plate type axial piston pump. The displacement varying mechanism thereof mainly has, similarly to the conventional arrangement described above, a control cylinder 11 having a piston rod 12 connected to one side of a swash plate 13, a pilot conduit 14 for guiding the pilot pressure of the discharge side of the pump 10 to the control cylinder 11, a solenoid switching valve 15 interposed in the pilot conduit 14, and a switching valve driving circuit 16 for electrically switching the position of the switching valve 15. A compression spring 17 is attached to the other side of the swash plate 13 to press the swash plate 13 so as to always maximize the swash plate angle $\theta$, i.e., the discharge capacity, and the spring force of the compression spring 17 is set to be changed depending on the pilot pressure of the discharge side of the pump 10. Reference numeral 18 denotes a damping pilot conduit for loading the pilot pressure in order to stabilize the compression spring 17.

In the embodiment described above, a drive source 19 for driving the hydraulic pump 10 is a gasoline or diesel engine (hereinafter referred to as "an engine"), and includes a starter motor 20 to start the engine 19. A start detector 22, for detecting that the starter motor 20 is energized so that the engine 19 is in the starting state, is provided in an electric circuit 21 for the starter motor 20. The start detector 22 is an electric signal generator for generating an electric signal in response to the starting of the engine 19. More specifically, this may be considered a relay switch connected in series with the starter motor 20 or a pulse signal generator which detects the rpm of the engine 19 to generate a signal corresponding to the rpm of the engine 19. Further, the pulse signal generator may be considered to be an electromagnetic pickup mounted opposite the periodic uneven surface of the end of the flywheel of the drive source 19, a primary voltage side of an igniter when the drive source 19 is a gasoline engine, or an electromagnetic pickup in a distributor when the drive source 19 is an electronic control fuel injection engine. The start detector 22 is connected to the input unit of a controller (e.g., a microcomputer) 23 for controlling the switching valve driving circuit 16.

The controller 23 determines that the engine 19 is in the starting state according to a signal from the start detector 22. That is, when the start detector 22 is a relay switch, the controller 23 determines a starting time by the fact that the signal from the relay switch corresponds to a voltage (approx. 8 V or higher) of a battery 24. Or, when the start detector 22 is a pulse signal generator, the controller 23 determines a starting time by the fact that the time duration between pulses is a predetermined value or more. When the engine 19 is in the starting state, the controller 23 issues a control signal to the switching valve driving circuit 16 for opening the switching valve 15. Accordingly, when a starter switch 25 is closed to start the engine 19, the duty solenoid of the switching valve 15 is driven to open the switching valve 15 for the control cylinder 11; and the pilot pressure of working oil discharged in a minute amount by the start of rotation of the hydraulic pump 10 immediately acts on the control cylinder 11 to minimize the swash plate angle $\theta$. In this manner, the discharge capacity of the hydraulic pump 10 is minimized or zeroed, and the driving load of the hydraulic pump 10 is also minimized or zeroed to moderate the load applied to the engine 19 by the hydraulic pump 10.

When the engine 19 is started, the energization of the starter motor 20 is stopped, and a signal indicating this state is sent to the controller 23 by the start detector 22. When the controller 23 receives the signal from the start detector 22, the controller 23 reversely drives the duty solenoid of the switching valve 15 by issuing a control signal to the switching valve driving circuit 16 to close the switching valve 15. As a result, the hydraulic pump 10 is returned to a normal operating state.

In the embodiment described above, in the case that a pulse signal generator for detecting the rpm of the engine is employed as the start detector 22, when the rpm of the engine 19 becomes a predetermined value or lower, the discharge capacity of the hydraulic pump can be controlled so that the driving load of the hydraulic pump 10 is minimized or zeroed. In the case that the driving load of the pump is large, when the rpm of the engine 19 has been reduced, there is a fear that the engine may be stalled from the load of the hydraulic pump 10. However, the discharge capacity of the pump can be controlled in response to the rpm of the engine to control the driving load of the pump, thereby eliminating the above-described problem.

The variable displacement type hydraulic pump 10 is not limited to the above-described swash plate type axial plunger pumps. It can be readily understood by those skilled in the art that other types of pumps such as oblique shaft type pumps may be employed. The drive source 19 for driving the hydraulic pump 10 is not limited to internal combustion engines such as a gasoline engine. The drive source 19 may also be an electric motor. Further, in order to move the swash plate 13, the displacement varying mechanism of the hydraulic pump 10 may employ a stepping motor instead of the control cylinder 11. In this case, the stepping motor is disposed so as to regulate the inclination angle $\theta$ of the swash plate 13, and the rotating direction and amount of the stepping motor can be controlled on the basis of the signal from the controller 23.

According to the present invention as described above, since the discharge capacity of the hydraulic pump is reduced when the drive source is started to reduce the driving load of the pump, the load applied to the drive source is also reduced. Particularly, when the viscosity of working oil is high at low temperatures, its effect becomes remarkable. Accordingly, when a gasoline engine or a diesel engine is employed as the drive source, the starting properties thereof are improved. In addition, the power consumed by a battery required for a starter motor is reduced, and the lifetime of the starter motor is prolonged. When the drive source is an electric motor, the power consumption of the motor at the starting time is reduced.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. A driving load controller for a variable displacement type hydraulic pump comprising a relay connected in series with a starter motor for detecting that a drive source for driving said variable displacement type hydraulic pump is in a starting state, a controller for outputting a signal for minimizing the driving load of said hydraulic pump when said controller determines that said drive source is in the starting state in response to a signal from said relay switch, and driving load varying means for minimizing the driving load of said hydraulic pump by a signal from said controller.

2. A driving load controller for a variable displacement type hydraulic pump according to claim 1, wherein said drive source is an internal combustion engine such as a gasoline engine or a diesel engine.

3. A driving load controller for a variable displacement type hydraulic pump according to claim 1, wherein said drive source is an electric motor.

4. A driving load controller for a variable displacement type hydraulic pump according to claim 1, wherein said variable displacement type hydraulic pump is a swash plate type axial piston pump.

5. A driving load controller for a variable displacement type hydraulic pump according to claim 1, wherein said driving load varying means comprises a displacement varying mechanism of said hydraulic pump to reduce the discharge capacity of said hydraulic pump to zero or to a minimum by a signal from said controller, thereby minimizing the driving load of said hydraulic pump.

6. A driving load controller for a variable displacement type hydraulic pump comprising a pulse signal generator for detecting the rpm of a drive source for driving said variable displacement type hydraulic pump to generate a signal corresponding to the rpm of said drive source, a controller for outputting a signal for minimizing the driving load of said hydraulic pump when said controller determines that said drive source is in the starting state in response to a signal from said pulse signal generator, and driving load varying means for mimimizing the driving load of said hydraulic pump by a signal from said controller.

7. A driving load controller for a variable displacement type hydraulic pump according to claim 6, wherein said drive source is an internal combustion engine such as a gasoline engine or a diesel engine.

8. A driving load controller for a variable displacement type hydraulic pump according to claim 6, wherein said drive source is an electric motor.

9. A driving load controller for a variable displacement type hydraulic pump according to claim 6, wherein said variable displacement type hydraulic pump is a swash plate type axial piston pump.

10. A driving load controller for a variable displacement type hydraulic pump according to claim 6, wherein said driving load varying means comprises a displacement varying mechanism of said hydraulic pump is reduce the discharge capacity of said hydraulic pump to zero or to a minimum by a signal from said controller, thereby minimizing the driving load of said hydraulic pump.

* * * * *

UNITED STATES PATENT AND TRADEMARK OFFICE

CERTIFICATE OF CORRECTION

PATENT NO. : 5,066,201

DATED : November 19, 1991

INVENTOR(S) : K. Nagai et al

It is certified that error appears in the above-identified patent and that said Letters Patent is hereby corrected as shown below:

Column 1, line 41 after "started" insert comma --,--; line 68 after "load" change "working" to --varying--.

Column 2, line 50 after "engine")", delete ", and", insert --having--; line 51, delete "includes".

Column 4, line 24, after "relay" insert --switch--.

Signed and Sealed this

Twenty-third Day of March, 1993

*Attest:*

STEPHEN G. KUNIN

*Attesting Officer*

*Acting Commissioner of Patents and Trademarks*